United States Patent [19]

Lacourt

[11] 4,172,675

[45] Oct. 30, 1979

[54] BINDING MECHANISM FOR LOOSE-LEAF BINDER

[76] Inventor: Daniel Lacourt, 41, Allee de la Libération, 57100 Thionville, France

[21] Appl. No.: 886,426

[22] Filed: Mar. 14, 1978

[30] Foreign Application Priority Data

Mar. 18, 1977 [FR] France ..... 77 08256

[51] Int. Cl.[2] ..... B42F 13/12

[52] U.S. Cl. ..... 402/27; 402/28; 402/48; 402/55; 402/56

[58] Field of Search ..... 402/48, 49, 52, 28, 402/55, 29, 56, 60

[56] References Cited

U.S. PATENT DOCUMENTS

| | | | |
|---|---|---|---|
| 634,545 | 10/1899 | Stahle et al. | 402/60 X |
| 763,176 | 6/1904 | Gresham et al. | 402/56 |
| 1,031,220 | 7/1912 | Williams | 402/27 |
| 1,155,382 | 10/1915 | Teamer | 402/28 |

FOREIGN PATENT DOCUMENTS

| | | | |
|---|---|---|---|
| 401389 | 9/1924 | Fed. Rep. of Germany | 402/55 |
| 472343 | 9/1929 | Fed. Rep. of Germany | 402/48 |

*Primary Examiner*—Robert L. Spicer, Jr.
*Attorney, Agent, or Firm*—Lewis H. Eslinger

[57] ABSTRACT

The present invention relates to a binding mechanism for loose-leaf binder comprising, mounted on a support, at least two rings each constituted by a fixed vertical receiver pin, the upper end of which is hollow, a fixed, vertical, tubular hoop-guide and a movable hoop-shaped member engaged, in closed position, in the upper end of the pin and slidable vertically in the hoop-guide and pivoting in a plane parallel to the plane of the leaves, to come to open position. The simultaneous control of the movement of the hoops is effected by a slide provided with ramps, the lower ends of the hoops being engaged both in fixed ramps fast with the support and in the ramps for controlling the slide. The invention is particularly applicable to binders or folders for perforated leaves.

22 Claims, 14 Drawing Figures

10
83
7
22
44
2
102
115
116
F
4
43
80
101
113
1
81
8
82
31
3
42
117
9a
V
114a
114
50
114b
9
112
41
111
114c
84
V
44
21
2

FIG. 7
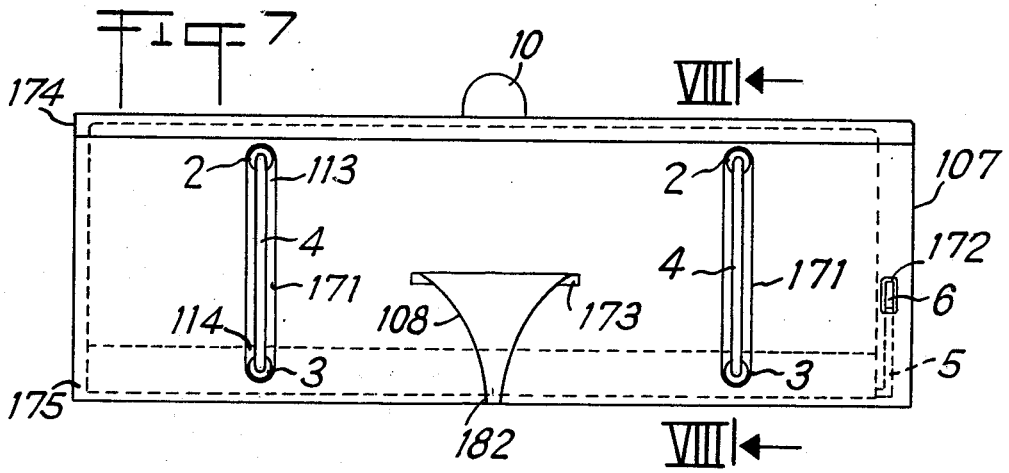
FIG. 10
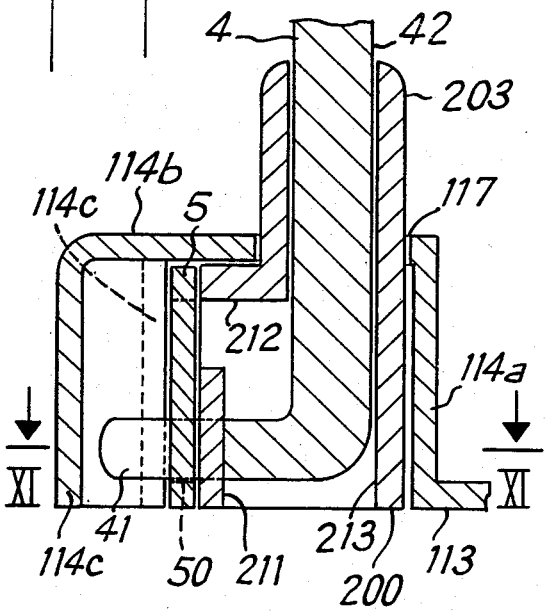
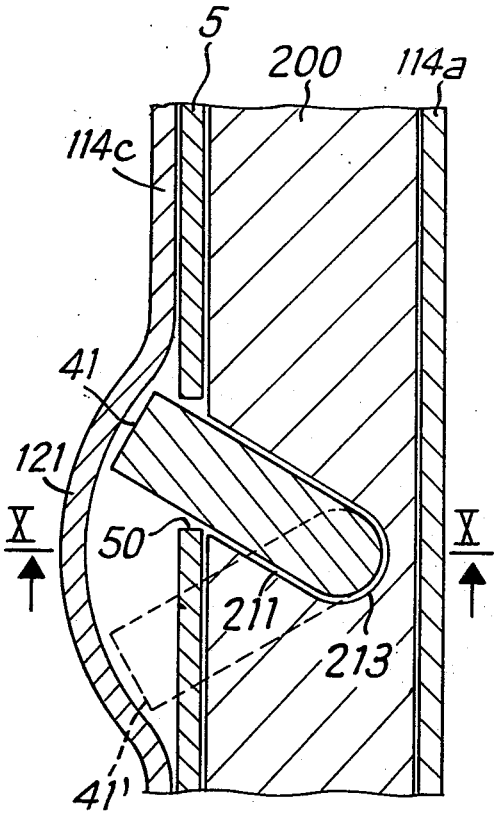
FIG. 11

BINDING MECHANISM FOR LOOSE-LEAF BINDER

The present invention generally relates to binding mechanisms for loose-leaf binders, of the type comprising a support, at least two receiver elements fast with the support and adapted to be engaged in perforations made in the loose leaves, and more particularly to mechanisms of the type comprising a support, at least two rings each composed of at least two parts, at least one of which is fast with the support, and the other, which is mobile, may pivot with respect to the support.

Loose-leaf binders must be adapted both to a frequent consultation of the bound documents and to an actualization or a simple bringing up to date of these documents, without the leaves of which these documents are constituted being damaged during handling.

Loose-leaf binders are known, equipped with ring-mechanisms for which each ring is constituted by two half-rings capable of pivoting in a plane perpendicular to the edge of the perforated leaves. Each half ring is subjected to the action of a spring and the abutment of the two half-rings against each other in closed position is effected by pressure, the projecting free ends of the two half-rings, which are broken, being provided to engage in each other. Such a system presents numerous drawbacks, particularly as the manoeuvring of the half-rings involves a considerable force and the half-rings become less contiguous as soon as there is a clearance in the mechanism. Furthermore, such mechanisms often cause a premature deterioration of the leaves by tears at the perforations, caused in particular by the action of the pivoted half-rings which, at each manoeuvre, push or pull the leaves by the perforations, or by the leaves being caught between the projecting ends of the half-rings. Rings are also known for loose-leaf binders which comprise three parts, namely a fixed, cylindrical, receiver pin, a movable hoop-shaped member and a tubular hoop-guide. Such rings, which must be manoeuvred individually by hand often render handling long and tedious when the leaves in a binder are bound with the aid of several rings.

A binding mechanism for a loose-leaf binder is also known which comprises rings composed of two parts, one of which is fixed and the other movable under the action of a manoeuvring lever. The fixed parts of the rings are constituted by vertical pins fast with a support, bent over in their upper part and terminated at their free end by a point. The movable parts of the rings are constituted by bent pins, or hoops, mounted on the support so as to be able to pivot in a plane perpendicular to the edge of the leaves under the action of the manoeuvring lever. The free end of the movable hoops is provided with a recess adapted to enclose the point of the free end of the corresponding fixed pin when the rings are closed. Such a mechanism facilitates bringing the leaves in a binder up to date, i.e., removal, addition or rearrangement of any leaves in the file. However, the necessity of having an efficient abutment of the movable hoop against the fixed pin in closed position of the rings is translated by a mechanism which remains relatively difficult to manoeuvre. Furthermore, the point formed at the end of the fixed pins may damage the leaves when they are inserted in the binder. Moreover, the manoeuvring lever which, when the rings are opened, pivots upwardly, tends to hinder the insertion, rearrangement or removal of the loose leaves. Finally, such a mechanism is not well adapted to the control of the simultaneous manoeuvre of more than two rings, with the aid of a single lever.

To avoid the deformation of the perforations in the leaves when the binder is being handled or when the binder is in vertical position, binding mechanisms have also been proposed which comprise, in particular, a self-contained movable pressure member which engages in the fixed pins so as to rest on the leaves to be held in place and to hold said leaves due to a disengageable friction system enabling the presser member to be wedged on the fixed pins. However, such a device remains of reduced efficiency and does not enable the leaves to be sufficiently blocked.

It is precisely an object of the present invention to remedy the above-mentioned drawbacks and to provide a binding mechanism for loose-leaf binders which allows easy manoeuvring, whilst presenting a good mechanical resistance, and guarantees a good holding of the perforations of the leaves when they are inserted, consulted or removed. It is a further object of the present invention to provide a binding mechanism which is less bulky for a maximum volume of leaves.

These objects are attained, due to the invention, in a binding mechanism for loose-leaf binder, of the type comprising a support and at least two rings, each composed of three parts: a fixed, vertical, cylindrical receiver pin, the base of which is fast with the support and which is hollow at its upper free end; a fixed, vertical, cylindrical, tubular hoop-guide, the base of which is fast with the support and which is mounted parallel to the receiver pin; and a movable hoop-shaped member presenting a first vertical arm, a second vertical arm parallel to the first arm and of shorter length, and the lower end of which is free and a connecting portion connecting the upper ends of the first and second arms, the first vertical arm of the movable hoop being engaged in the hoop-guide and adapted to slide and pivot therein, and the free, lower end of the second arm being adapted to engage in the upper, hollow part of the receiver pin, wherein the lower end of the first arm of each movable hoop is provided with a control appendix, the mechanism further comprises, in a number equal to the number of rings, fixed guide ramps fast with the support, provided to cooperate with the appendices for controlling the hoops and having a first lower vertical portion and a second upper horizontal portion, and the mechanism also comprises a member for controlling the movement of the movable hoops, constituted by a movable slide adapted to slide with respect to the support, which slide is provided with control ramps inclined with respect to the horizontal and provided to cooperate with the appendices controlling the movable hoops, the control ramps being in a number equal to the number of rings of the binding.

Thus, according to the present invention, the opening and closing of all the rings may be effected simultaneously and smoothly with the aid of a single slide without any force being exerted on the leaves which are in contact with the receiver pins and/or possibly the vertical hoop-guides and not the movable hoops which effect a vertical displacement and a rotation about a vertical axis without provoking displacement of the leaves. The addition and removal of the leaves are also facilitated by the fact that the receiver pins are vertical, not bent and do not present a sharp upper end.

The support of the binding mechanism is advantageously constituted by a plate, of which the part supporting the hoop-guides is raised and constitutes a section in the form of an upturned U, inside which are engaged the appendices of the movable hoops and the slide controlling the movement of the hoops.

According to a first embodiment of the invention, the fixed guide ramps are formed in the support itself.

According to another embodiment of the invention, the fixed guide ramps are formed in a cast piece mounted in the support.

The ramps guiding the movement of the movable hoops are preferably constituted by grooves in which are engaged the appendices of the movable hoops.

The ramps for controlling the movement of the movable hoops formed in the control side are constituted by slots or grooves in which are engaged the appendices of the movable hoops.

The functioning of the mechanism according to the invention is facilitated if the appendices of the movable hoops are inclined by an angle $\beta$ of between about 15° and 45°, and preferably 30°, with respect to the plane defined by the two vertical arms of said hoops, and if each movable hoop may pivot by an angle $\alpha$ of between about 30° and 90°, and preferably 60° between the position of complete opening of the rings and the position of closure of the rings.

To increase efficiency of the pressure exerted on the loose-leaves when they are consulted, and to avoid forces being exerted on the perforations, a binding mechanism is produced of the type comprising a support, at least two receiver elements fast with the support and adapted to be engaged in the perforations of the loose leaves, and a presser member for exerting a pressure on the loose leaves engaged in the receiver elements, in which mechanism, according to the invention, the presser member is connected to the support and may be retracted by being pivoted with respect to the support about an axis perpendicular to the receiver elements.

According to a particular embodiment of the invention, the presser member is constituted by a presser plate mounted to pivot with respect to the support, provided with perforations in those parts coming opposite the receiver elements or rings in which the leaves are engaged, and applied against the leaves by means of a spring leaf fixed by one of its ends to the support.

In this case, it is advantageous if the spring leaf fixed by one of its ends to the base support in a zone located between the axis of pivoting of the presser plate and the receiver elements passes through the presser plate at a slot formed in said plate parallel to its pivot axis, terminates by a second end located near the axis of pivoting of the presser plate and presents, in section perpendicular to the axis of pivoting of the presser plate, a curvature whose concavity faces downwardly.

The spring leaf preferably presents a width which reduces from its end fixed to the base support to its end located near the pivot axis of the presser plate.

The invention will be more readily understood on reading the following description with reference to the accompanying drawings, in which:

FIG. 7 is a plan view of a variant embodiment of the binding mechanism according to the invention.

FIGS. 10 and 11 are vertical and horizontal sections, respectively, of a detail of the assembled binding mechanism corresponding to the embodiment of FIG. 9.

Figure 1:
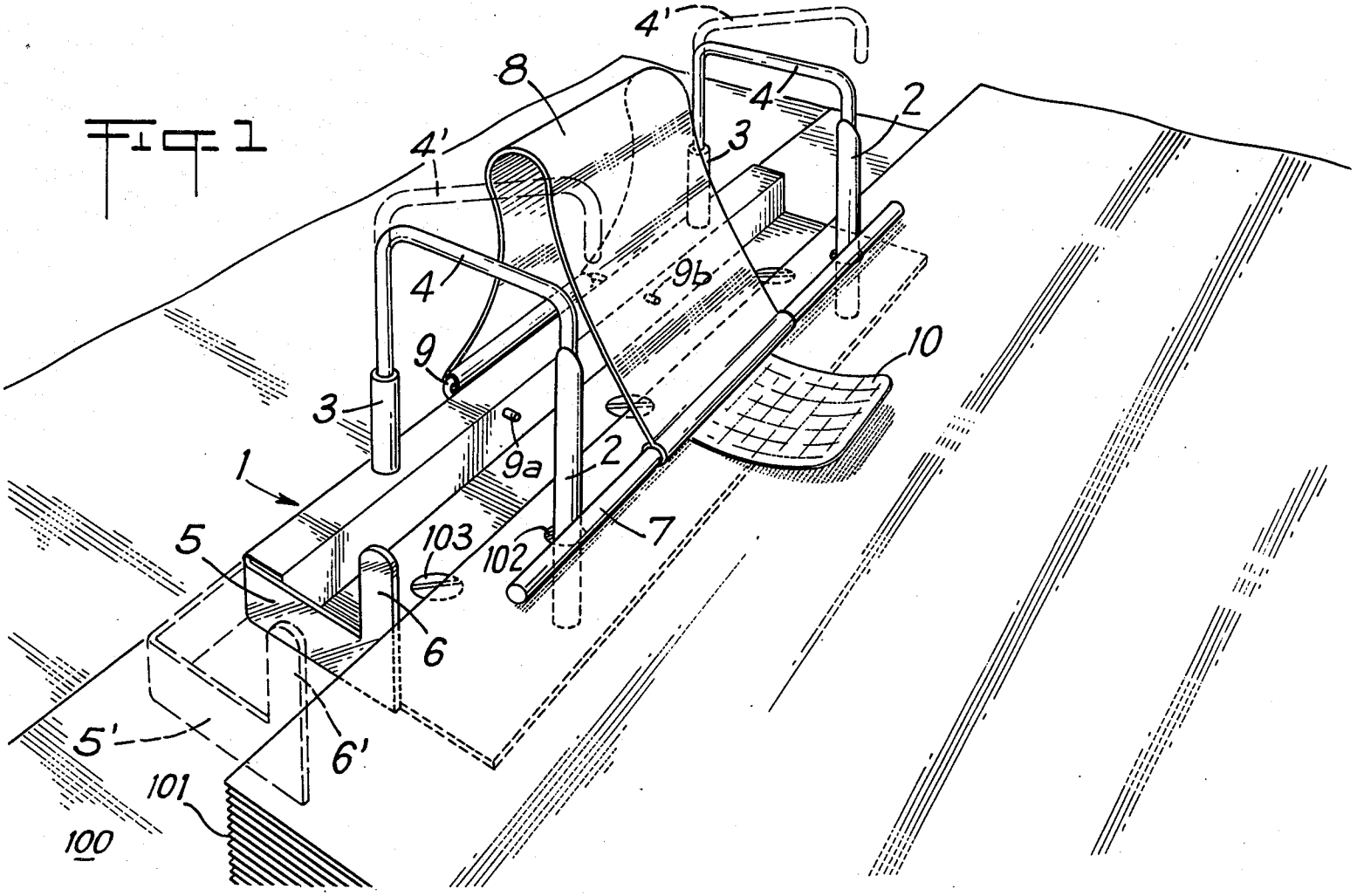
FIG. 1 is a view in perspective of a binding mechanism according to the invention, mounted on a loose-leaf binder.
Figure 2:
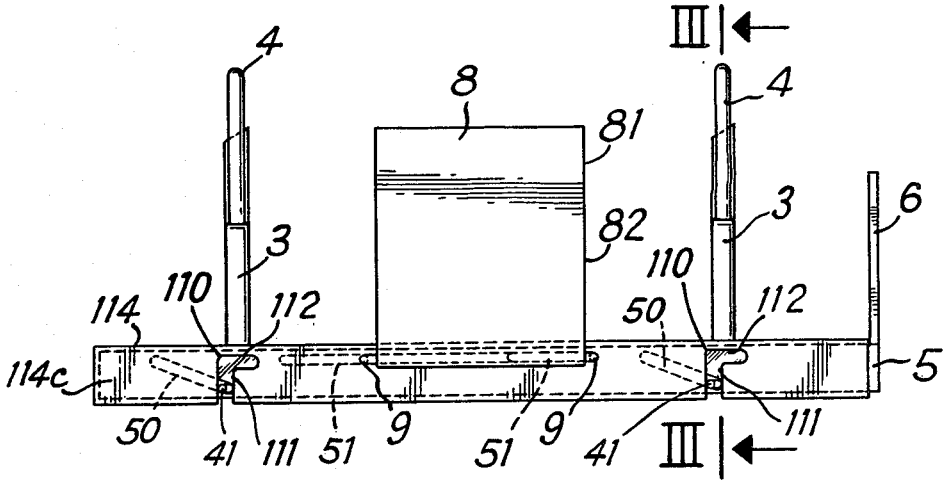
FIG. 2 is a view in elevation of a first embodiment of a binding mechanism according to the invention.

Referring now to the drawings, FIG. 1 shows a mechanism according to the invention, mounted on a binder cover 100 and intended to bind loose leaves 101 provided with perforations 102. A mechanism support 1 is fixed on the cover 100 with the aid of connecting elements such as screws or rivets 103. Cylindrical receiver pins 2 are mounted on one side of the support 1 and ensure a positioning of the leaves 101 engaged in the pins 2 at their perforations 102. Cylindrical pins or hoop-guides 3 mounted vertically on the support 1 opposite pins 2 and at a distance therefrom, ensure the guiding of movable hoop-shaped members 4 capable of engaging by their upper free end in the upper portion of the receiver pins 2 or of being released and pivoting about the axis of the hoop-guides 3 under the action of a control slide 5 mounted to slide in the support 1 on the hoop-guide 3 side and provided with a manoeuvring lever 6.

In FIG. 1, the hoops 4 are shown in closed position in solid lines, with the corresponding position in solid lines of the control slide 5 provided with its lever 6. When the lever 6 is pulled to position 6' to bring the slide 5 to position 5', shown in broken lines, each of the rings constituted by a receiver pin 2, a hoop-guide 3 and a hoop 4 is opened, due to the movement of the movable hoops 4 which, under the action of the control slide 5 are lifted, leave the pins 2 and pivot to their open position 4' shown in broken lines.

A retractable presser assembly 7,8,9,10, shown in operating position, ensures that the leaves 101 are firmly held against the cover 100 and avoids any forces being exerted on the perforations 102 when the leaves 101 are consulted. The presser assembly essentially comprises a presser rod 7 which is held applied on the leaves 101 and in abutment against the pins 2 under the action of a two-arm element forming clip 8, such as a spring leaf, one end of which is connected to the rod 7 whilst the other end is wound around a fixed shaft 9 of which the bent ends **9*a* and 9*b* are engaged in the support 1 on the side of the part supporting the hoop-guides 3. A tongue 10 facilitates the manoeuvring of the presser assembly which may be retracted under the action of the spring leaf 8 and escape the rings 2,3,4 to enable leaves 101 to be removed, inserted or rearranged when the hoops 4 are in open position 4'**.

A first embodiment of the device according to the invention is described in greater detail with reference to FIGS. 2 to 6. The mechanism shown in FIGS. 2 to 6 is in accordance with the device shown in FIG. 1 and identical elements bear the same references. The support 1 is constituted by a sectioned plate, preferably made of metal, which is provided to give rigidity to the binding mechanism whilst being of reduced dimensions. The support plate 1 comprises a first, substantially flat part 113 fixed to the frame of the binder by connecting elements 103, and supporting the receiver pins 2, and a second part 114 in the form of an upturned U comprising two vertical walls 114*a*, 114*c* and an upper horizontal wall 114*b*, which supports the hoop guides 3 and contains the elements for controlling the hoops 4. The receiver pins 2 may be fixed to the part 113 of the support 1 in holes such as 116 by crimping, brazing . . . and are located on the side of the end 115 of the support 1 opposite the U-shaped part 114. The hollow, cylindrical hoop-guides 3 are fixed in openings 117 made in the upper horizontal part 114*b* of the U-part 114, for example by crimping, welding, brazing.

Fixed guide ramps 110 are formed in one of the vertical faces of the U-part 114, referenced 114*c*, and are in the form of slots made opposite the hoop-guides 3. Each slot 110 comprises a first lower vertical portion 111 and a second, upper horizontal portion 112 which forms an angle with the portion 111. Slots 50 constituted by rectilinear elongated recesses inclined with respect to the horizontal are formed in the control slide 5 inserted in the U-part 114 of the support 1 and capable of sliding longitudinally in this part 114. The fixed guide ramps 110 and the slots 50 acting as movable ramps cooperate to ensure the control of the movement of the hoops 4 by means of lugs or appendices 41 which constitute the lower part of the hoops 4.

Figures 3, 4:
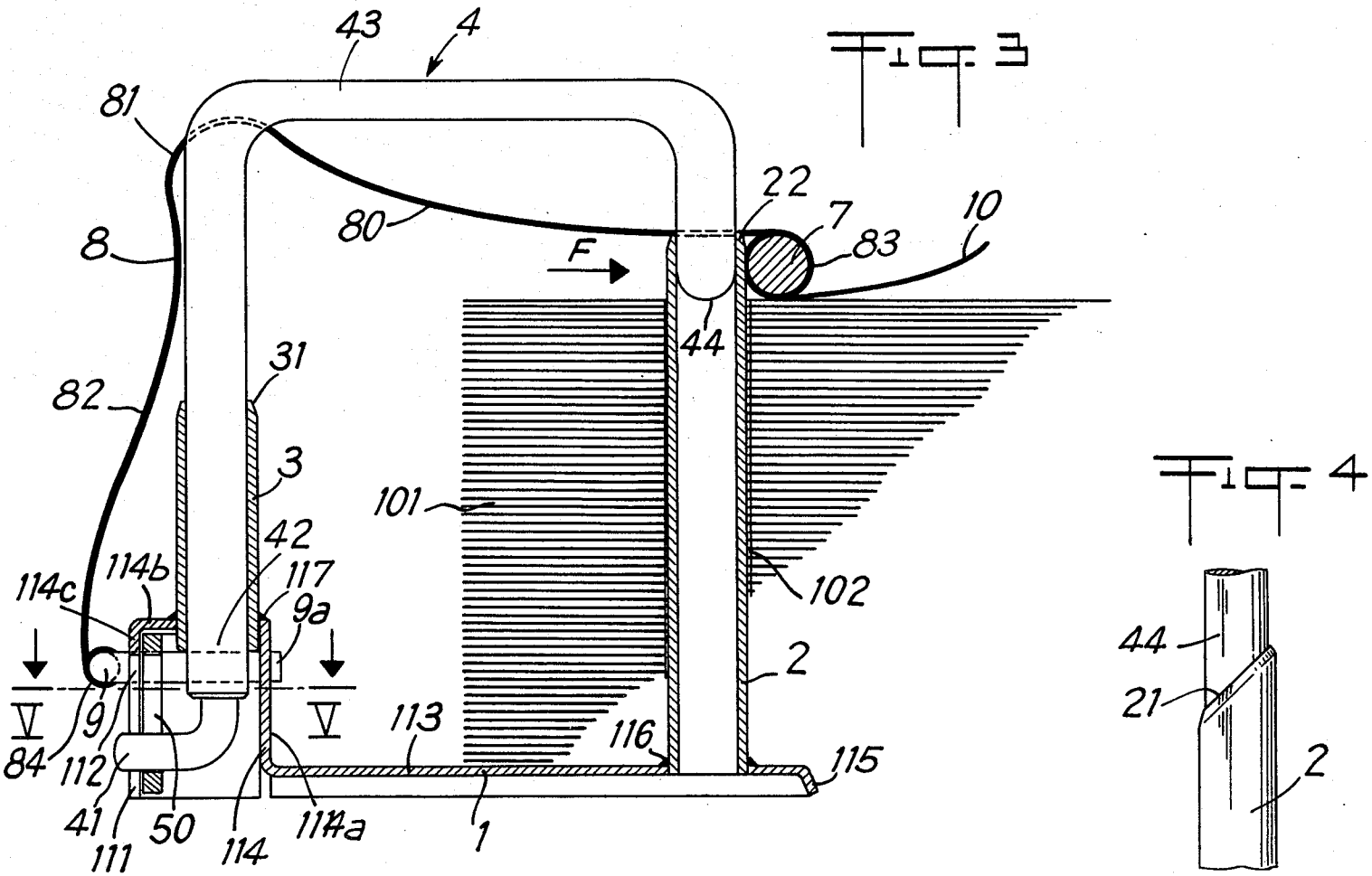
FIG. 3 is a view in section along III—III of FIGS. 2 and 6.
FIG. 4 is a detailed view in the direction of arrow F of FIGS. 3 and 8.

As may be seen more particularly in FIG. 3, each hoop 4 comprises a first vertical arm 42 engaged in a hoop-guide 3 and able to slide and pivot therein, a second vertical arm 44 parallel to the first arm 42, of shorter length and having a preferably rounded or conical free lower end, without sharpness, adapted to engage in the upper hollow part of a receiver pin 2, a connecting part 43 connecting the upper ends of the arms 42 and 44, and a control appendix 41 connected to the lower end of the arm 42. The connecting part 43 may be substantially horizontal and connected to the arms 42 and 44 by elbows of relatively small radius of curvature, as shown in FIG. 3. Such a conformation allows a better support for the cover of the binder when said cover is folded down on the rings 2,3,4 in closed position of the binder. However, the connecting part 43 could also be curved or have any suitable form. For example, the connecting part 43 may be slightly flattened (FIG. 3), so as to present a reduced thickness in the vertical direction and slightly reduce the height of the binding mechanism without reducing the capacity of the binder, whilst facilitating rotation of the leaves in the hoop 4, whilst the vertical arms 42 and 44 remain of substantially circular section. A flattening of the connecting part 43 further facilitates folding of the hoops during manufacture.

As may be seen in FIG. 4, it is advantageous if the upper, free end of the receiver pins 2 is higher in the part located opposite the direction of displacement of the movable hoops 4 and constitutes a stop for the ends of the arms 44 of the hoops 4 when said hoops are returned into closed position. Such a feature (chamfered form 21) facilitates the engagement of the arms 44 in the pins 2 but is not indispensable, the pins 2 also being able to terminate at their upper end in a horizontal opening. The upper free ends 31 and 22 respectively of the hoop-guides 3 and the receiver pins 2 are advantageously slightly chamfered. The hoop-guides 3 may be of substantially equal height (FIG. 8), or preferably a little lower (FIG. 1) than the height of the receiver pins 2.

The appendices 41 of the hoops 4 may be connected to the arms 42 or be integral therewith and shaped by folding. This latter operation is facilitated when the appendices 41 have a slightly reduced section with respect to that of the vertical arms 42 of the hoops 4.

Figure 5:
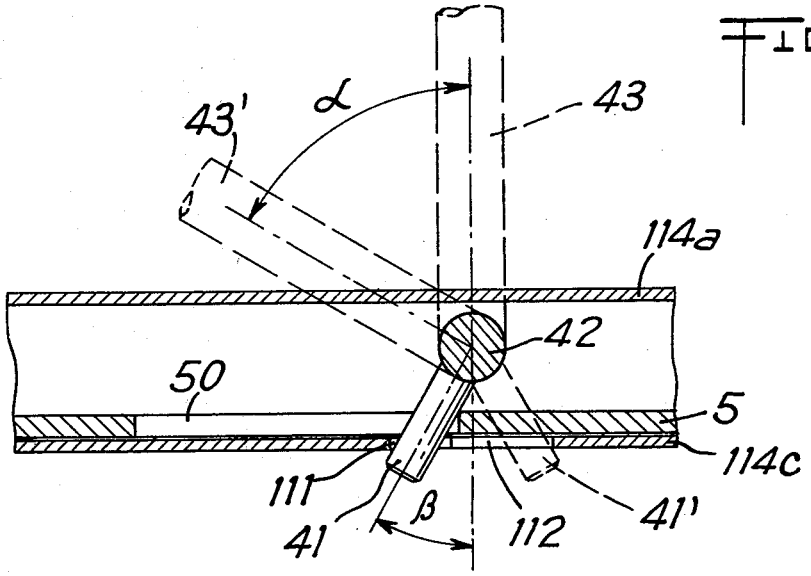
FIG. 5 is a section along V—V of FIG. 3.

The appendices 41 of the hoops 4 are preferably substantially perpendicular to the vertical arms 42, 44 and are inclined with respect to the plane defined by the two vertical arms 42, 44 by an angle $\beta$ of between about 15° and 45°, and preferably of the order of 30° (FIG. 5).

Figure 6:
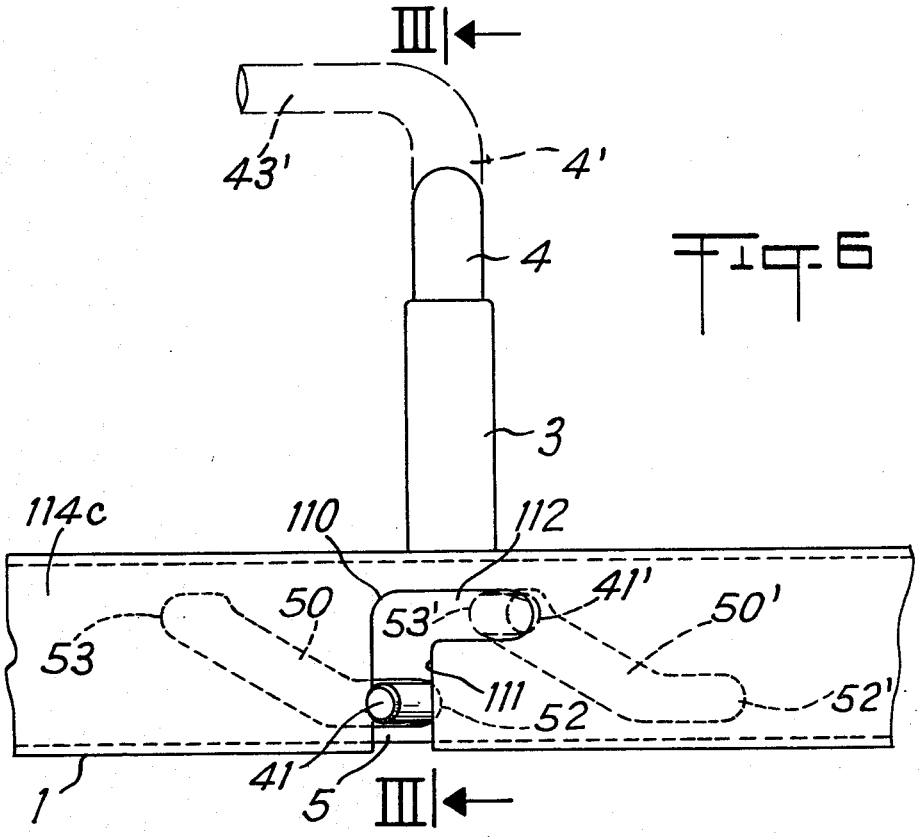
FIG. 6 is an enlarged view of part of FIG. 2.

The dimensions of the ramps 110 and 50 are preferably chosen so that each movable hoop 4 can pivot by an angle $\alpha$ of between about 30° and 90°, and preferably 60°, between its position 4'; 43' of complete opening and its position of closure 4; 43. With reference to FIGS. 5 and 6, the solid lines show a hoop 4 provided with an appendix 41 which is in closed position. The appendix 41 is located both in the lower part of the vertical arm 111 of the fixed ramp 110 and on the side of the lower end 52 of the corresponding movable ramp 50 of the slide 5 which is in pushed back position (FIG. 1). If the slide 5 is pulled to bring it to position 5' (FIG. 1), the ramp 50 formed in the slide 5 at opening 110 moves to position 50', taking with it the appendix 41 which is firstly guided in the vertical portion 111 of the fixed ramp 110, then in the horizontal portion 112 to come, finally, into the upper position 41' corresponding to the opening 4' of the hoop 4 and to the upper end 53' of the movable ramp 50'. In its open position 43', the connecting part 43 of the hoop 4 is raised by a height corresponding to the height of the ramp 111 so that the end of the arm 44 may escape the receiver pin 2 and has pivoted by an angle $\alpha$ about the axis of the hoop-guide 3 (i.e., of the vertical arm 42 of the hoop) in a horizontal plane parallel to the leaves to come into position 43' allowing an easy engagement of the leaves in the receiver pin 2. The pivoting angle $\alpha$ of a hoop 4 is determined in particular by the length of the portion 112 of the fixed ramp 110.

The slide 5 presents control ramps 50 in a number equal to the number of hoops 4 and naturally in a number equal to the number of fixed guide ramps 110, so that all the hoops 4 of the same binding mechanism are controlled simultaneously by manoeuvring the slide 5. The Figures show inclined movable ramps 50 of which the lower part 52 is located on the slide manoeuvring lever 6 side. The ramps 50 could naturally be inclined in the opposite direction, the upper part 53 being nearest the lever 6, so that the hoops 4 would be closed when the slide 5 is pulled and open when the slide 5 is pushed. The inclination of the movable ramps 50 may be more or less pronounced but is advantageously such that each movable ramp 50 makes with the horizontal an angle of about 2°. The upper part of a ramp 50 must in all cases be located at the level of the horizontal upper portion 112 of the corresponding fixed ramp 110. Various modifications of the shape of the fixed ramps 110 and movable ramps 50 may be envisaged according to the applications. Thus, the ramps 50 may present a horizontal portion at their upper and lower ends 53 and 52 respectively, corresponding to the positions of complete opening and of complete closure of the hoops 4 and ensuring a locking in these positions (FIG. 6).

When the hoops 4 are in closed position (FIGS. 2 and 3), the presser assembly 7,8,9,10 ensures that the leaves 101 are held firmly and avoids their being damaged at the perforations 102 when they are consulted. The spring leaf 8 made of thin steel, which connects the presser rod 7 to the support 1, comprises an end 83 wound around the presser rod 7 and an end 84 mounted to pivot about a shaft 9 engaged by its ends 9*a* and 9*b* in the part 114 of the support 1. Horizontal slots 51 (FIG. 2) are formed in the slide 5 at the ends 9*a* and 9*b* of the axis 9 so as not to hinder the sliding movements of the slide 5, whilst being able to act as stroke limiter of the slide 5 with a view to avoiding forces of the appendices 41 against the ends of the ramps 110 or 50 when the hoops 4 are manoeuvred. In addition, the slide 5 may even be totally supported by the ends 9*a* and 9*b* of the axis 9, the guiding of the slide being effected along the face 114*c* of the support 1. The spring leaf 8 presents different curvatures between its ends 83 and 84, seen in section perpendicular to the shaft 9 and to the rod 7 (FIG. 3), from the end 84 of the parts 80,81,82, so that, in operating position, the presser 7,8 exerts an efficient locking action on the leaves whilst, when the leaves are rearranged, the force to be exerted to cause the presser 7,8 to pivot is relatively low.

Figure 8:
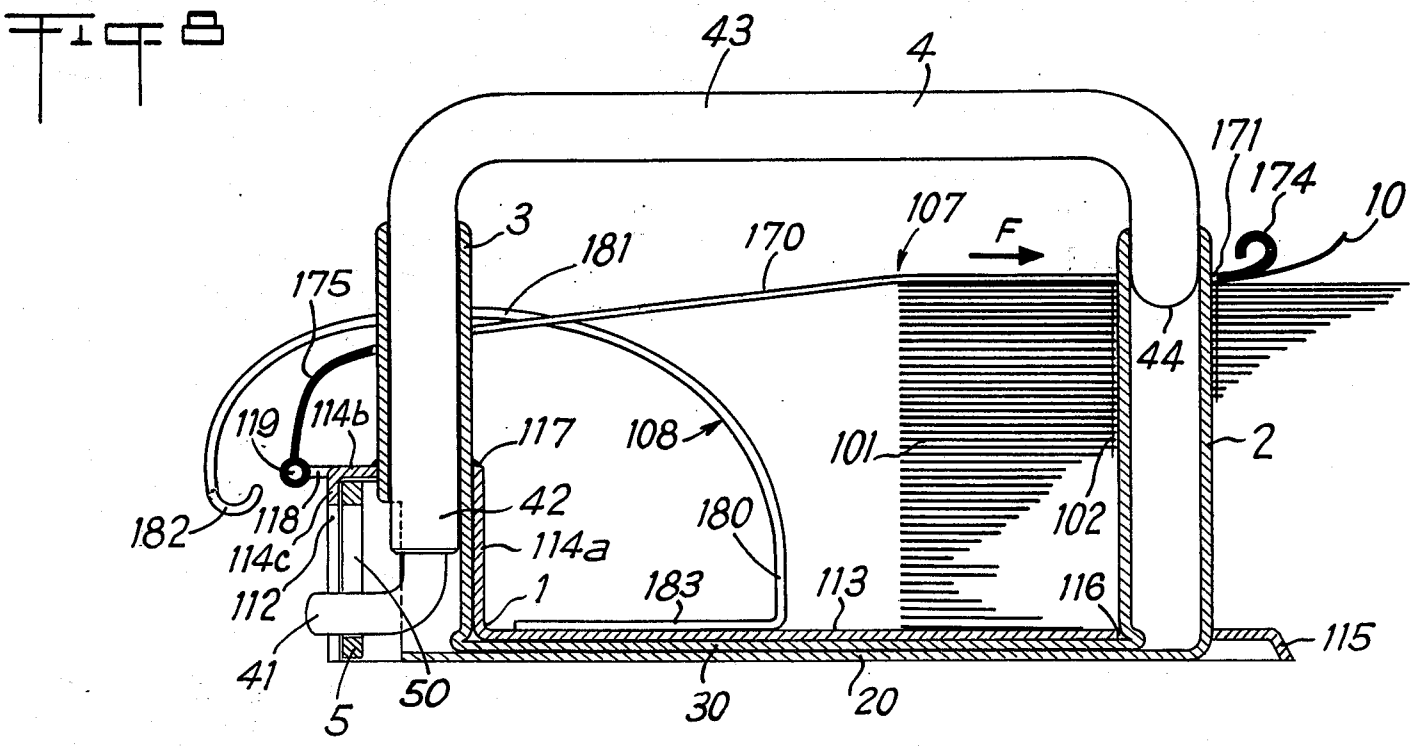
FIG. 8 is a section along VIII—VIII of FIG. 7.

FIGS. 7 and 8 show a variant embodiment of the binding mechanism previously described. The rings 2,3,4 and the system for controlling the movement of the hoops 4 are similar to those described previously. However, the presser assembly which acts on the leaves 101 to block them, and which remains connected to the support 1 and retractable by pivoting with respect to the support 1, comprises a presser plate 107 mounted to pivot about a shaft 119 fixed to a piece 118 fast with the U-part 114 of the support 1. The plate 107 is provided with perforations or recesses 171 in the parts located, for the operating position shown in FIGS. 7 and 8, opposite the receiver elements 2 and more generally the rings 2,3,4 in which are engaged the leaves 101. The plate 107 may have an opening 172 for the passage of the lever 6 for manoeuvring the slide 5 placed in position of closure of the hoops 4. The mechanism for controlling the movement of the hoops 4 can then only be manoeuvred when the plate 107 is raised by the tongue 10 and retracted by pivoting about shaft 119. The plate 107 may be made of metal and be substantially flat at least in its central part 170. The end 174 of the plate 107 bearing on the leaves 101 may also be slightly bent, similarly to the portion 175 close to the pivot axis so as to increase the rigidity of the plate.

An opening 173 is formed in the plate 107 parallel to its pivot axis 119 itself parallel to the U-section 114. A spring leaf 108 is fixed by one of its ends 183 to the base 113 of the support 1 in a zone located between the ring elements 2 and 3 and passes through the slot 173 of the plate 107 to exert a pressure thereon. The leaf 108 presents, seen in profile, in operating position (FIG. 8), from its fixed end 183, a first portion 180 of short length which may be substantially vertical and a second, curved portion 181 of which the concavity faces downwardly. The leaf 108 terminates near the pivot axis 119 in an end 182 which may be slightly curved upwardly. As may be seen in FIG. 7, the spring leaf 108 advantageously presents a width which reduces from its end 183 fixed to the base support 113 to its free end 182 located near the pivot axis 119 of the presser plate 107. The effect exerted by the leaf 108 on the plate 107 is thus maximum when the plate is in position of abutment on the leaves 101 (operating position of FIG. 8) and reduces progressively in the course of the raising and retracting operation of the plate 107 with the aid of the tongue 10. The presser assembly 107, 108 is particularly adapted to binding mechanisms using rings 2,3,4, the height of which is relatively reduced, i.e., preferably smaller than or equal to the width of the rings. Such a presser assembly 107, 108 of reduced dimensions may be used in particular in a binding mechanism for perforated leaves not using movable hoops and which are composed exclusively of receiver pins 2 in which the perforations of the leaves engage, and which may be equipped at their upper end for example with screws which serve to hold the leaves.

A presser assembly 7,8 as shown in FIGS. 1 to 6 is on the contrary particularly adapted to be integrated in a binding mechanism comprising rings 2,3,4, the height of which is relatively great, i.e., close to the width of the rings, of more.

FIG. 8 shows another variant embodiment of the hoop-guides 3 and receiver pins 2 which are, for the same ring 2,3,4, made from a common element such as a common tube, the central, horizontal part 20, 30 of which is flattened to be applied against the base plate 1, and the two side ends 2,3 of which, bent at 90°, form vertical pins engaged in the openings 116 and 117 made respectively in the parts 113 and 114*b* of the base plate 1. The part of the tube forming hoop-guide 3 is cut out at its base to allow the appendix 41 of the hoop 4 cooperating with the pins 2 and 3 to leave.

Figure 9:
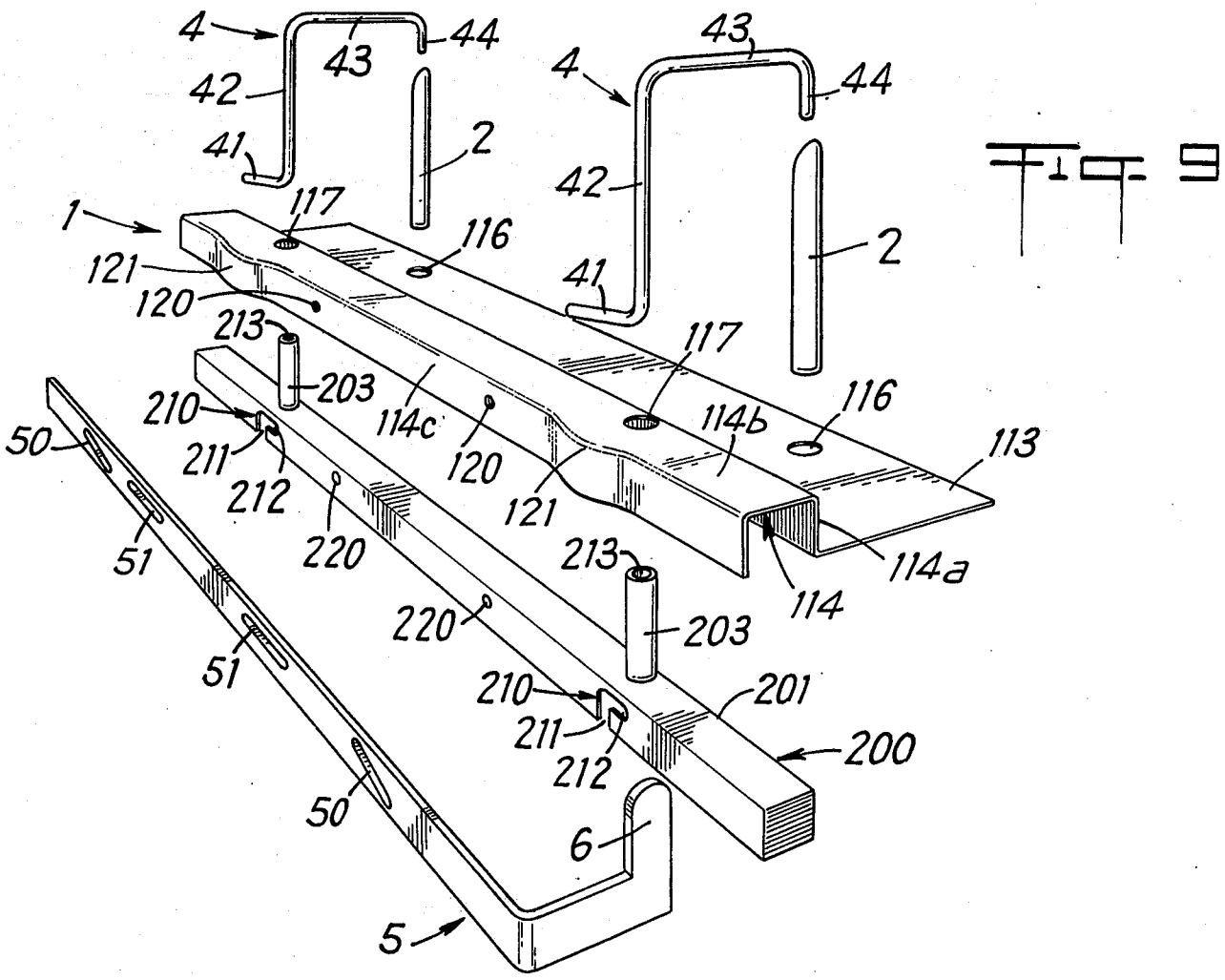
FIG. 9 is an exploded view of another embodiment of the mechanism according to the invention.

FIGS. 9 to 11 refer to another embodiment of the binding mechanism according to the invention in which the fixed ramps for guiding the movement of the hoops 4 are not formed in the support 1 itself, but in a cast piece 200 inserted in the U-part 114 of the support 1 and immobilised with respect to this latter.

Referring in particular to FIG. 9, a cast piece 200 is shown which may be made of metal, plastic material or any other castable material, and presents a body 201, the general shape of which is substantially parallelepipedic to correspond to the shape of the U-section 114. The piece 200 is slightly less wide than the face 114*b* of the section 114 so that a free space is made between the face 114*c* of the section 114 and the piece 200, which space corresponds to the width of the slide 5. As may be seen in FIG. 12, the slide 5 engaged in the section 114 is thus guided between the face 114*c* of the section 114 and the cast piece 200. Fixed guide ramps 210 acting the same role as the guide ramps 110 are formed in the face of the cast piece 200 located opposite the slide 5. Each ramp 210 comprises a vertical groove 211 followed by a horizontal groove 212 (FIGS. 9 to 11) serving to guide the appendices 41 of the hoops 4 engaged in the member 200. The face 114*c* of the part 114 of the support 1 constitutes both a means for guiding the slide 5 and a cover for the members 5,200 for controlling the movement of the hoops 4. Swells 121 are provided in the face 114*c* of the support 1 at each combination of ramps 50,210 so that the movement of the appendices 41 engaged in the ramps 210 and 50 is not hindered. As in the scope of the other embodiments of the invention, an appendix 41 of hoop 4 is slightly inclined with respect to the plane defined by the corresponding hoop-guide 203 and the pin 2, so that the grooves 211 corresponding to the slide of the hoops 4 in the hoop-guides 203 are also inclined with respect to a straight section of the body of the member 200.

The cast member 200 may comprise only one bore 213 at the level of grooves 210 and beneath the openings 117 of the support 1 to allow passage of the vertical arms 42 of the hoops 4. In this case, the hoop-guides are connected on the face 114*b* of the support 1 and the receiver pins 2 are supported on the part 113 of the support at the level of the holes 116. However, the hoop-guides 203 may also be formed on the body 201 of the cast member 200 (FIGS. 9 and 10) and form an integral part of this latter. The receiver pins 2 may also be formed with the cast member 200 and form an integral part of this latter, each pin 2 being connected to the body 201 of the member 200 by a horizontal flat part. The member 200 is then engaged beneath the support as before, the pins 2 and the hoop-guides 203 fast with the member 200 engaged in the openings 116 and 117 respectively of the support 1. The support 1, the cast member 200 and the slide 5 may be provided, respectively, with holes 120, 220 and with horizontal elongated slots 51 to allow the passage of ends 9*a*, 9*b* of a shaft 9 supporting a presser assembly such as assembly 7, 8 or 107, 108 shown in FIGS. 3 and 8.

Figure 12:
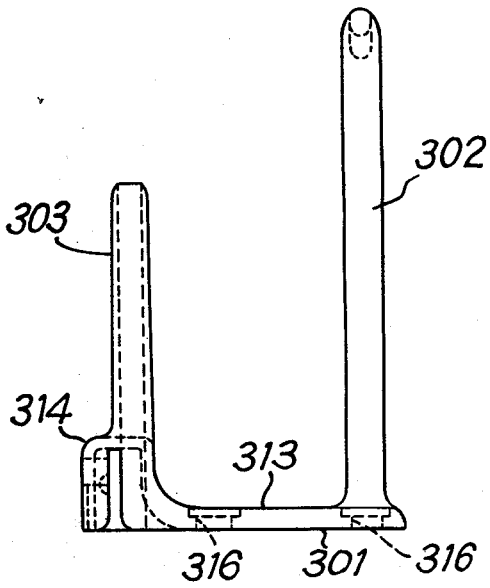
FIGS. 12 and 13 are front and side views respectively of another embodiment of a mechanism according to the invention, in which the movable elements have been removed.
Figure 13:
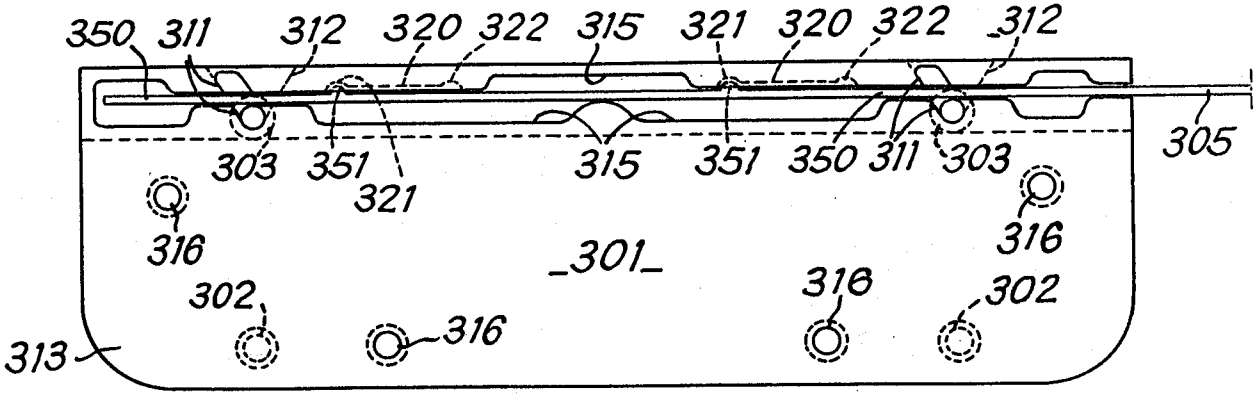
Figure 14:
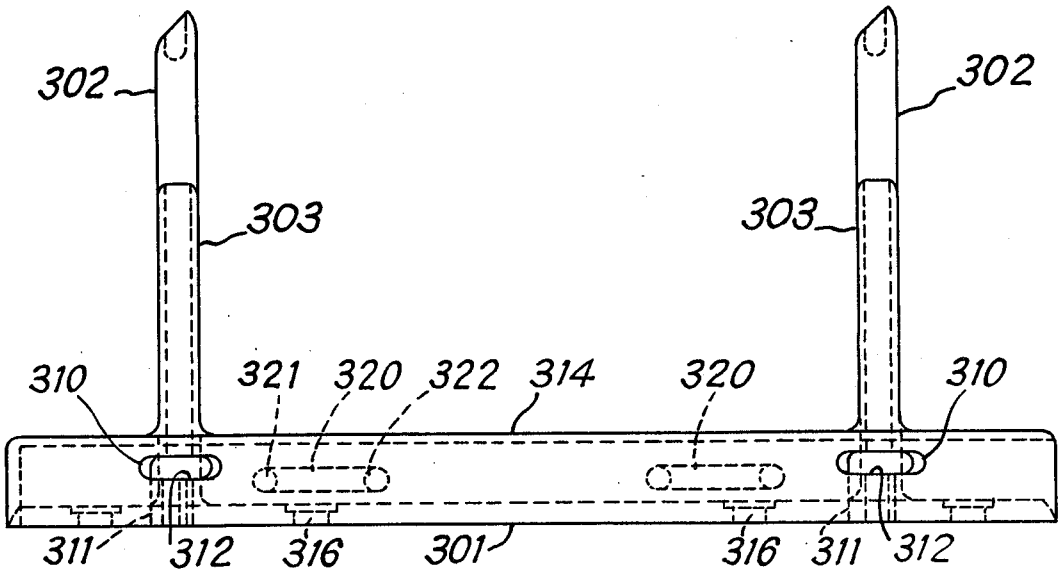
FIG. 14 is a view from underneath of the mechanism of FIGS. 12 and 13, provided with its control slide.

FIGS. 12 to 14 show a variant embodiment of a binding mechanism according to the invention in which the support 301, which has a low part 313 in the form of a plate and a raised part 314 in the form of an upturned U, the pins 302, the hoop-guides 303 and the fixed ramps 310 are formed in the same cast member, for example made of plastic material, the hoops themselves being made of metal.

The different elements constituting the mechanism may undergo numerous modifications in shape. Thus, the hoop-guides 303 and the pins 302 may have a slightly conical, upwardly narrowing outer form. This slight outer conicity, which facilitates removal from the mould, in particular, may moreover by only partial, and be made only on certain faces of the pins 302 (FIG. 14).

The ramps 310 present a vertical part 311 in the form of a groove and a horizontal part 312 in the form of a slot. The orifices 316 made in part 313 serve for passage of means for fixing the mechanism on a cardboard support.

As may be seen in FIG. 13, the slide 305 for controlling the movement of the movable hoops may comprise, in addition to the inclined ramps 350 made in the form of slots as before, bosses 351 which cooperate with fixed horizontal ramps 320 formed in one of the vertical faces of the U-part 314 of the mechanism. A boss 351 which slides in a groove 320 ensures a guiding and possibly a support of the slide 305 when said latter slides. Each groove 320 advantageously has at each of its ends a deeper part 321, 322 respectively, which ensures a locking of the position of the slide in closed or open position of the rings, when a boss 351 is engaged in a deeper recessed part 321 or 322. The slide 305 may be easily unlocked by a slightly increased pulling or pushing force, as recesses 315 made in the U-part 314 enable the slide 305 to be easily deformed in the transverse direction under a manual action to allow the bosses 351 to escape from the deeper recesses 321, 322.

The Figures show a binding mechanism with two rings, but the invetion is very advantageously applied to mechanisms having a larger number of rings. In each case, the slide 5,305 comprises a number of ramps 50,350 equal to the number of rings and the fixed ramps 110,210, 310 are also in a number equal to the number of rings. The slide 5,305 each time allows a simultaneous control of the different rings and distributes the forces uniformly at the lever of each ring.

Various modifications and/or additions may of course be made by the man skilled in the art to the devices which have just been described solely by way of non-limiting examples, without departing from the scope of protection of the invention. For example, a return spring may be provided in the support 1 to facilitate the return of the slide 5 into position of closure of the rings. Similarly, removable presser assemblies may be used in combination with the ring mechanism.

What is claimed is:

1. In a binding mechanism for loose-leaf binder, of the type comprising a support and at least two rings, each composed of three parts: a fixed, vertical, cylindrical receiver pin, the base of which is fast with the support and which is hollow at its upper free end; a fixed, vertical, cylindrical, tubular hoop-guide, the base of which is fast with the support and which is mounted parallel to the receiver pin; and a movable hoop-shaped member presenting a first vertical arm, a second vertical arm parallel to the first arm and of shorter length, and the lower end of which is free and a connecting portion connecting the upper ends of the first and second arms, the first vertical arm of the movable hoop being engaged in the hoop-guide and adapted to slide and pivot therein, and the free, lower end of the second arm being adapted to engage in the upper, hollow part of the receiver pin, the lower end of the first arm of each movable hoop is provided with a control appendix, the mechanism further comprises, in a number equal to the number of rings, fixed guide ramps fast with the support, provided to cooperate with the appendices for controlling the hoops and having a first lower vertical portion and a second upper horizontal portion, and the mechanism also comprises a member for controlling the movement of the movable hoops, constituted by a movable slide adapted to slide with respect to the support, which slide is provided with control ramps inclined with respect to the horizontal and provided to cooperate with the appendices controlling the movable hoops, the control ramps being in a number equal to the number of rings of the binder.

2. The binding mechanism of claim 1, wherein the support is constituted by a plate, of which the part supporting the hoop-guides is raised and constitutes a section in the form of an upturned U, inside which are engaged the appendices of the movable hoops and the slide controlling the movement of the hoops.

3. The binding mechanism of claim 1, wherein the fixed guide ramps are formed in the support itself.

4. The binding mechanism of claim 1, wherein the fixed guide ramps are formed in a cast piece mounted in the support.

5. The binding mechanism of claim 4, wherein the hoop-guides and/or the receiver pins are formed in the cast piece comprising the fixed guide ramps and mounted on the support.

6. The binding mechanism of claim 1, wherein the support, the fixed guide ramps, the hoop-guides and the receiver pins are constituted by a single cast piece.

7. The binding mechanism of claim 1, wherein the fixed ramps guiding the movement of the movable hoops are constituted by grooves in which are engaged the appendices of the movable hoops.

8. The binding mechanism of claim 1, wherein the ramps for controlling the movement of the movable hoops formed in the control slide are constituted by slots or grooves in which are engaged the appendices of the movable hoops.

9. The binding mechanism of claim 1, wherein the ramps for controlling the movement of the movable hoops formed in the control slide present a horizontal portion at their upper and/or lower end corresponding respectively to a position of complete opening and complete closure of the hoops, to ensure a locking of the position of the hoops in these positions.

10. The binding mechanism of claim 1, wherein the movable slide is further provided with at least one boss cooperating with at least one fixed horizontal ramp formed in the support to ensure a guiding and, as necessary, a support for the slide in its longitudinal slide movement.

11. The binding mechanism of claim 1, wherein the movable slide is provided with at least one boss cooperating with recesses formed in the fixed part of the mechanism, and the slide may be slightly deformed in the transverse direction, to allow a locking of the slide in open and/or closed position of the hoops.

12. The binding mechanism of claim 1, wherein the free end of the receiver pins is higher in the part located opposite the direction of displacement of the movable hoops and constitutes a stop therefor.

13. The binding mechanism of claim 1, wherein the upper free ends of the hoop-guides and the receiver pins are chamfered.

14. The binding mechanism of claim 1, wherein the lower free end of the second arm of the movable hoops is rounded or conical.

15. The binding mechanism of claim 1, wherein the appendices of the movable hoops are inclined by an angle of between 15° and 45°, and preferably 30°, with respect to the plane defined by the two vertical arms of said hoops.

16. The binding mechanism of claim 1, wherein each movable hoop may pivot by an angle of between about 30° and 90° and preferably 60°, between the position of complete opening of the rings and the position of closure of the rings.

17. The binding mechanism of claim 1, wherein the hoop-guides are shorter than the receiver pins.

18. The binding mechanism of claim 1, wherein the appendices of the movable hoops are substantially perpendicular to the vertical arms of said hoops.

19. In a binding mechanism for a loose-leaf binder, of the type comprising a support, at least two receiver elements fast with the support and adapted to be engaged in the perforations of the loose leaves, and a presser member for exerting a pressure on the loose leaves engaged in said receiver elements, the presser member is connected to the support and may be retracted by being pivoted with respect to the support.

20. The binding mechanism of claim 19, wherein the presser member is constituted by a presser plate mounted to pivot with respect to the support, provided with perforations in those parts coming opposite the receiver elements or rings in which the leaves are engaged, and applied against the leaves by means of a spring leaf fixed by one of its ends to the support.

21. The binding mechanism of claim 20, wherein the spring leaf fixed by one of its ends to the base support in a zone located between the axis of pivoting of the presser plate and the receiver elements passes through the presser plate at a slot formed in said plate parallel to its axis of pivoting, terminates by a second end located near the axis of pivoting of the presser plate and presents, in section perpendicular to the axis of pivoting of the presser plate, a curvature whose concavity faces downwardly.

22. The binding mechanism of claim 20, wherein the spring leaf presents a width which reduces from its end fixed to the base support to its end located near the pivot axis of the presser plate.

* * * * *